US007325633B2

(12) United States Patent
Lindén et al.

(10) Patent No.: US 7,325,633 B2
(45) Date of Patent: Feb. 5, 2008

(54) ROCK DRILL BIT AND A THREAD JOINT THEREFOR

(75) Inventors: Johan Lindén, Gävle (SE); Bo Carlström, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 149 days.

(21) Appl. No.: 11/205,189

(22) Filed: Aug. 17, 2005

(65) Prior Publication Data

US 2006/0060388 A1 Mar. 23, 2006

(30) Foreign Application Priority Data

Aug. 17, 2004 (SE) ..... 0402026

(51) Int. Cl.
*E21B 10/36* (2006.01)
*B23B 51/12* (2006.01)

(52) U.S. Cl. ..... 175/414; 175/417; 408/233

(58) Field of Classification Search ..... 175/417, 175/414, 395, 320; 408/233
See application file for complete search history.

(56) References Cited

U.S. PATENT DOCUMENTS 2,052,019 A * 8/1936 Baker ..... 403/343
2,160,158 A * 5/1939 Lind ..... 175/417
2,606,778 A * 8/1952 Myhre ..... 403/361
3,258,077 A * 6/1966 Phipps ..... 175/389
3,519,092 A * 7/1970 Miller ..... 175/426
3,800,892 A * 4/1974 Fischer ..... 175/426
4,296,825 A * 10/1981 Larsson ..... 175/426
7,185,721 B2 * 3/2007 Carlstrom et al. ..... 175/414

FOREIGN PATENT DOCUMENTS

| | | |
|---|---|---|
| GB | 673307 | 10/1951 |
| GB | 658631 | 6/1952 |
| JP | 8-151885 | 6/1996 |
| WO | WO 03/042493 | 5/2003 |
| WO | WO 2006/019346 A1 | 2/2006 |

* cited by examiner

*Primary Examiner*—Kenneth Thompson
(74) *Attorney, Agent, or Firm*—Drinker Biddle & Reath LLP

(57) ABSTRACT

A drill bit intended for percussive rock drilling is formed to reduce the occurrence of cavitation during percussive drilling. The drill bit includes an integral skirt and at least one channel for transport of flush medium, such as water. The drill bit has a front face provided with buttons, which define a greatest first external diameter (D0). A recess with a female thread, such as a rope or trapezoid thread for percussive drilling, extends into the drill bit from a rear end face of the drill bit. The recess has an axial depth (L0). The external surface of the skirt includes a conical portion having an axial extension that is greater than one-eighth of the depth (L0) of the recess but smaller than the depth (L0) of the recess.

23 Claims, 2 Drawing Sheets

ROCK DRILL BIT AND A THREAD JOINT THEREFOR

The present application claims priority under 35 U.S.C. § 119 to Patent Application Serial No. 0402026-9 filed in Sweden on Aug. 17, 2004.

FIELD OF THE INVENTION

The present invention relates to a rock drill bit intended for percussive rock drilling. The invention also relates to a thread joint for percussive rock drilling.

Thread joints in drill strings are exposed to great strains during percussive top hammer drilling where the drill string has the task to transfer impact energy from a top hammer to a drill bit at the free end of the drill string provided with cemented carbide cutting elements. Usually the individual drill rod has a female thread formed at one end intended to receive a male thread at an opposed end of another drill rod. Usually water, possibly with some additions for example for improving the lubrication, is used as a flushing medium in connection with drilling for partly removing cuttings from the bore and partly for lubricating and cooling the drill bit. The drill steel, i.e. the material in bits, rods, tubes, sleeves and shank adapters, is exposed during drilling to abrasive and corrosive attacks. This applies in particular to drilling underground where water is used as flush medium and where the environment generally is moist. Attacks are especially serious at parts of relatively small diameters, i.e. at thread ends or thread clearances.

WO-A1-03042493 has tried to come to terms with the effect of cavitation at percussive drilling. This has been done by covering the slender portions of the drill rod by means of a skirt of the drill bit. Thereby cavitation does not reach said slender portions but is guided towards coarser dimensions of the joint. Although the prior solution has improved the performance of these products, drifter rods sometimes have suffered from damage on the rod surface just behind the skirt on a rod that has been drilled far, such as 10,000 m. Damage is very local and has the form of a cut substantially around the whole rod circumference. The damage then functions as crack initiation point when the rod is subjected to violent bendings.

OBJECTS AND FEATURES OF THE INVENTION

The present invention aims to alleviate the above-captioned problem and to create an improved thread joint for percussive rock drilling, which further improves efficiency at modern mining.

Another object of the present invention is to provide a drill bit which reduces the formation of cavitation at percussive drilling.

Another object of the present invention is to provide a drill bit at which blasting effects and corrosion from exterior flush medium are reduced.

Still another object of the present invention is to provide a drill bit which extends the life-span at rock drill rods of slender dimensions.

According to the invention these objects are achieved by a drill bit for percussive rock drilling including an integral skirt which defines an axial center line. The bit includes an axial front face having rock crushing elements, at least one channel for conducting a flush medium, a recess extending forwardly by an axial distance L0 from a rear end face of the skirt, a female thread formed in the recess, and an external surface comprising a conical portion which extends rearwardly from a larger diameter end thereof to a smaller diameter end thereof. The larger diameter end is spaced from the rear end face by an axial distance which is greater than one-eighth of the distance L0 and is less than the distance L0, i.e., ⅛ LO<axial distance<LO.

Another aspect of the invention pertains to a percussive rock drill which comprises a drill bit attached to a drill rod by a thread joint. The drill bit includes an integral skirt and defines a longitudinal center line. The bit includes an axial front face having rock crushing elements, at least one channel for conducting a flush medium, a recess extending forwardly by an axial distance L0 from a rear end face of the skirt. A female thread formed in the recess, and an external surface comprising a conical portion which extends rearwardly from a larger diameter end thereof to a smaller diameter end thereof. The larger diameter end is spaced by an axial distance which is greater than one-eighth of the distance L0 and less than the distance L0.

BRIEF DESCRIPTION OF THE DRAWINGS

The objects and advantages of the invention will become apparent from the following detailed description of a preferred embodiment thereof in connection with the accompanying drawing in which like numerals designate like elements, and in which:

FIG. 3A showing area A2 and FIG. 3B showing area A3.

DESCRIPTION OF A PREFERRED EMBODIMENT OF THE INVENTION

Figure 1:
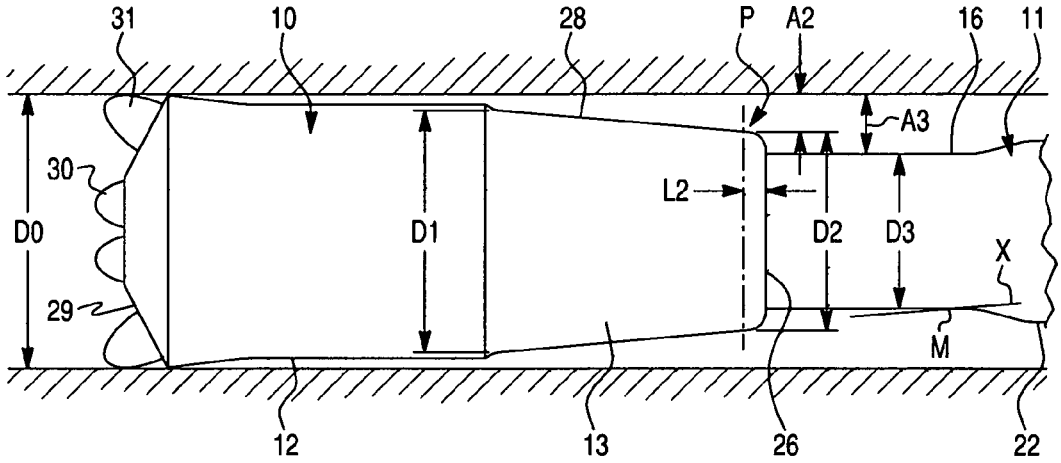
FIG. 1 shows a side view of a drill cutting through a rock formation according to the present invention.
Figure 2:
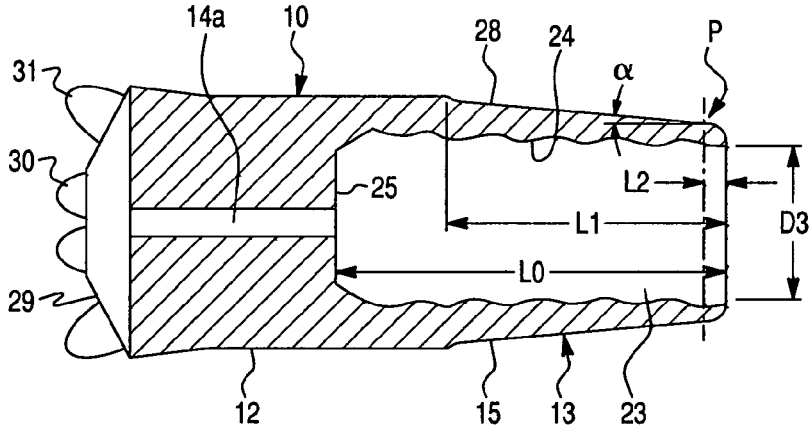
FIG. 2 shows a longitudinal cross-sectional view of a drill bit according to the present invention.
Figure 3A:
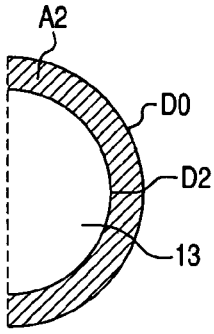
FIGS. 3A and 3B show schematic representations of two imaginary areas disposed radially outwardly of a drill bit skirt and a drill rod.
Figure 3B:
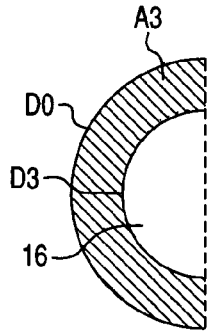

The present invention relates to a drill bit 10 for percussive rock drilling. A first drill rod 11 is shown in FIG. 1 connected to a skirt 13 integrated with the drill bit 10. The skirt 13 has an external surface 28 which could be entirely conical, but preferably includes a front cylindrical portion 12 and a rear conical portion 15. The drill bit 10 comprises a front face 29 which has a number of front buttons 30 and peripheral buttons 31, whereof only four are shown in FIG. 1. The peripheral buttons 31 define the diameter of the drilled bore in a conventional manner.

Figure 5:
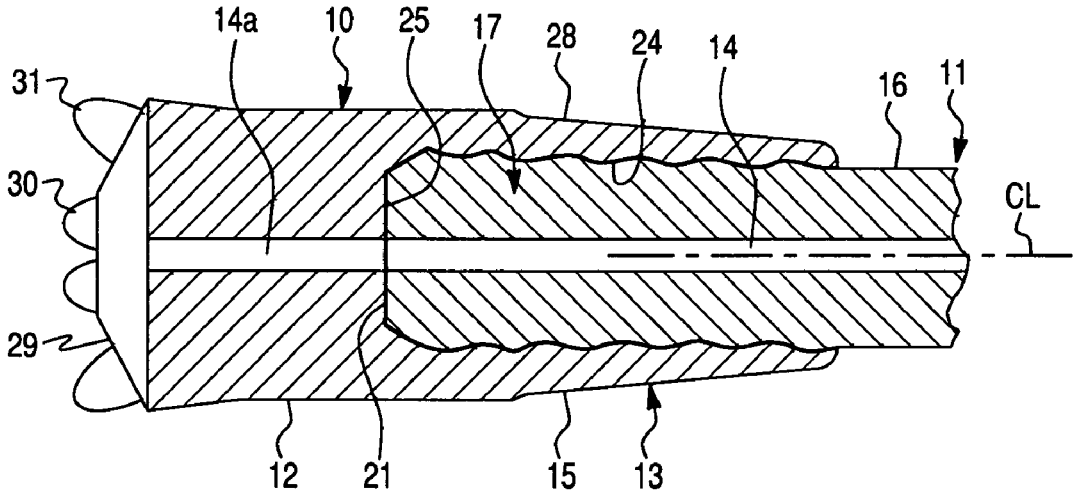
FIG. 5 shows a longitudinal section through the drill bit and drill rod according to the present invention.

The drill rod 11 and thereby the thread joint include at least one central channel 14 for transport of flush medium, such as water (see FIG. 5). Said channel 14 connects at least to one channel 14*a* in the drill bit 10. The drill rod 11 has a circular, radial cross-section and comprises a first external surface 16. The first external surface 16 has a substantially constant first external diameter D3 in the axial direction (FIG. 1). The drill rod 11 has a front end portion 17 or spigot provided with a male thread, such as a rope or trapezoid thread, for percussive drilling. The male thread may include a concave thread entrance or thread start and a concave thread exit or a thread end. The front end portion 17 comprises a first end face 21. The drill rod 11 comprises a second external surface 22 with a diameter that preferably is greater than the diameter D3. The skirt 13 of the drill bit 10 comprises a recess 23 having a female thread 24 and an internal abutment surface 25. The recess 23 extends axially forwardly from a second end face 26 of the skirt. The smallest diameter of the recess substantially corresponds to the diameter D3. The second end face 26 is substantially ring-shaped. The thread joint becomes mounted when the spigot 17 is threaded into the recess until the first end face 21 abuts against the internal abutment face 25.

As mentioned above, damage in the form of erosion or cavitation corrosion sometimes arises on the rod surface, e.g., at the exposed surface 16 in FIG. 1 just behind the skirt. Damage is very local and has the shape of a "notch" extending about basically the entire circumference. The damage then functions as a crack initiation point when the rod is subjected to violent bendings. The present invention intends to counteract such erosion or cavitation corrosion which occurs due to the turbulent flow that arises when flushing water flows past the ends of conventional drill bits. The drill bit 10 according to the present invention comprises an at least partly conical skirt 13. With a properly designed skirt the flushing water will continuously follow the shape of the skirt such that erosion and cavitation are substantially avoided or reduced to a great extent. The correct design in this connection implies gradual area change along the skirt and less abrupt area change at the end 26 of the skirt.

The dimensions of the drill bit are chosen according to the following equation foremost with reference to FIGS. 1-4:

$$1<A3/A2<1.6$$

where A2 is an imaginary area seen in a radial plane (i.e., a plane oriented perpendicular to the axial center line CL of the joint), the area A2 being bordered on the outside by the largest diameter D0 of the drill bit (corresponding to the diameter of the hole being drilled) and bordered on the inside by the outer diameter D2 of the skirt 13 taken at an axial distance L2 from the end face 26 (L2 to be described below). That area A2 is represented by cross-hatching on the right-hand side of FIG. 3A. Thus, $A2=\pi/4*(D0^2-D2^2)$.

The area A3 is an imaginary area seen in a radial plane, the area A3 being bordered on the inside by the smallest diameter D3 of the recess 23 (corresponding to the outer diameter of the non-threaded cylindrical portion 16 of the drill rod 11) and bordered on the outside by the largest diameter D0. The area A3 is shown cross-hatched on the left side of FIG. 3B. Thus, $A3=\pi/4*(D0^2-D3^2)$. The ratio A3/A2 preferably lies between 1.30 and 1.60.

Figure 4:
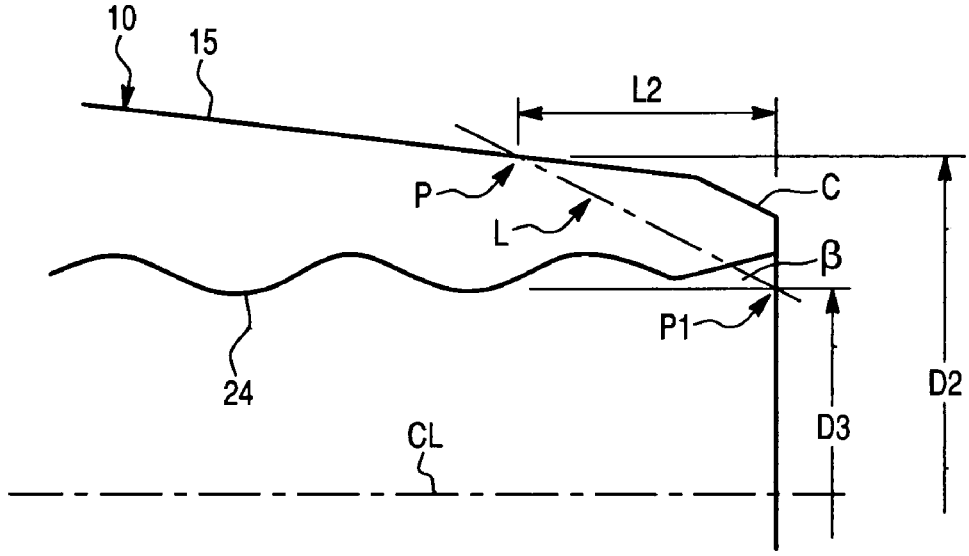
FIG. 4 shows a magnified portion of the thread joint in FIG. 2.

The reason for using the skirt diameter D2 at a distance L2 from the end face 26 in order to make the above calculations is to ensure that the diameter measurement is not influenced by the chamfer C that is commonly formed at the rear end of the skirt (see FIG. 4).

The axial distance L2 is measured parallel with the center line CL from the end face 26 to a point P defined by a point of intersection between the external surface 28 of the skirt and an imaginary line L. The line L extends at a 45° angle (β) from the intersection P1 of the second end face 26 of the skirt 13 and the internal diameter D3, as illustrated in FIG. 4.

The length L1 of the conical portion 15 of the skirt is greater than one-eighth of the depth L0 of the recess but smaller than the distance L0 of the depth of the recess, i.e., ⅛ L0<L1<L0. An imaginary apex of the conical portion 15 is located on the center line CL at an axial distance from the end face 26, which distance being greater than a quarter of the depth L0 of the recess. The greatest diameter DO of the drill bit lies within the interval of 30 to 50 mm. Drill bits of this magnitude are connected to relatively slender drill rods, which can break due to the circumferential cavitation notch discussed earlier.

The dimensions of the drill bit also fulfill the condition:

$$D3^2 < D2^2 < \left(\frac{1}{1.6}D3^2 + \frac{0.6}{1.6}D0^2\right)$$

More preferably, the drill bit dimensions fulfill the condition:

$$\frac{0.3}{1.3}D0^2 + \frac{1}{1.3}D3^2 < D2^2 < \frac{1}{1.6}D3^2 + \frac{0.6}{1.6}D0^2$$

At the end face 26 the amenable flow area where flushing water passes between the bore wall and the skirt is up to 60% greater than the corresponding area at the greatest diameter D0, according to the invention.

The external surface 28 of the skirt 13 comprises, in the shown embodiment of a cylindrical external surface 12 and the conical portion 15. By making the forward portion 12 of the external surface 28 of cylindrical shape, rather than conical, the wall thickness of the drill bit in the region of the abutment surfaces 21 and 25 will be relatively large, which provides a more load-resistant drill bit. The conical portion 15 forms an angle α with the center line CL of the drill bit. The angle α is greater than zero and maximum 15°, i.e. 0<α≦15°, preferably between 2 and 5°. The condition for the angle α is as follows:

$$\tan\alpha=(D1-D2)/2/(L1-L2),\ (\text{note: } \tan 0°=0 \text{ and } \tan 15°\approx 0.27)$$

$$0 < \left[\frac{\frac{1}{2}(D1-D2)}{(L1-L2)}\right] \leq 0.27$$

where L1 is the length of the conical portion 15, preferably about half of the depth L0 of the recess, and where L2=h=(D2−D3)/2, so as not to take the bevel C at the end face 26 into consideration.

D3 corresponds to the internal diameter that is limited by the thread tops in the drill bit. L2 can be determined from the line L extending 45° from the point of intersection between the end face 26 of the skirt and the internal diameter D3, as illustrated in FIG. 4. An imaginary extension line X of the conical portion 15 intersects the first external surface 16 of the drill rod at a point M located at an axial distance from the end face 26 that is greater than an eighth part of the depth L0 of the recess (see FIG. 5), i.e., axial distance>⅛ L0. The cylindrical external surface 12 has an axial extension rearwardly from a plane of the internal abutment face 25 that is maximum ⅞ of the depth L0 of the recess, i.e., rearward axial extension≦⅞ L0.

The chosen dimensions give relatively small geometrical transitions between parts 11 and 10 to diminish the extent of cavitation, such that the influence on the extension joint from cuttings and aggressive water is reduced. The flush medium may alternatively consist of a mixture of air and water.

The present invention consequently relates to a drill bit intended only for percussive rock drilling, preferably top hammer drilling. The drill bit 10 is formed such to reduce origin of cavitation at percussive drilling by guiding the flush medium in direction towards the rod 11.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A drill bit for percussive rock drilling including an integral skirt defining an axial center line, the bit including an axial front face having rock crushing elements, at least one channel for conducting a flush medium, a recess extending forwardly by an axial distance L0 from a rear end face of the skirt, a female thread formed in the recess, and an external surface comprising a conical portion which extends rearwardly from a larger diameter end thereof to a smaller diameter end thereof, wherein the larger diameter end is spaced from the rear end face by an axial distance which is greater than ⅛ of the distance L0 and less than the distance L0, and wherein an imaginary apex of the conical portion lies on the center line at a distance rearwardly from the rear end face, which distance is greater than ¼ of L0.

2. The drill bit according to claim 1 wherein a forward end of the recess is defined by an abutment surface, the external surface including a cylindrical portion surrounding the abutment surface.

3. The drill bit according to claim 2 wherein the conical portion forms an angle with the center line, the angle being greater than zero and no greater than 15 degrees.

4. The drill bit according to claim 3 wherein $$D3^2 < D2^2 < \left(\frac{1}{1.6}D3^2 + \frac{0.6}{1.6}D0^2\right)$$

where D3 is a smallest diameter of the recess, D0 is a largest outer diameter of the drill bit, and D2 is a diameter of the skirt at an axial distance L2 from the rear end face, the distance L2 determined by a line extending from a first point to a second point at an angle of 45 degrees relative to a plane extending perpendicularly to the center line at the rear end face of the skirt, the first point defined by an intersection of the plane with an imaginary extension of the smallest diameter of the recess, and the second point defined by an intersection of the line with the outer surface of the skirt, the distance L2 being the axial distance from the plane to the second point.

5. The drill bit according to claim 4 wherein $$\left(\frac{0.3}{1.3}D0^2 + \frac{1}{1.3}D3^2\right) < D2^2 < \left(\frac{1}{1.6}D3^2 + \frac{0.6}{1.6}D0^2\right).$$

6. The drill bit according to claim 1 wherein the conical portion forms an angle with the center line, the angle being greater than zero and no greater than 15 degrees.

7. The drill bit according to claim 1 wherein $$D3^2 < D2^2 < \left(\frac{1}{1.6}D3^2 + \frac{0.6}{1.6}D0^2\right)$$

where D3 is a smallest diameter of the recess, D0 is a largest outer diameter of the drill bit, and D2 is a diameter of the skirt at an axial distance L2 from the rear end face, the distance L2 determined by a line extending from a first point to a second point at an angle of 45 degrees relative to a plane extending perpendicularly to the center line at the rear end face of the skirt, the first point defined by an intersection of the plane with an imaginary extension of the smallest diameter of the recess, and the second point defined by an intersection of the line with the outer surface of the skirt, the distance L2 being the axial distance from the plane to the second point.

8. The drill bit according to claim 7 wherein $$\left(\frac{0.3}{1.3}D0^2 + \frac{1}{1.3}D3^2\right) < D2^2 < \left(\frac{1}{1.6}D3^2 + \frac{0.6}{1.6}D0^2\right).$$

9. The drill bit according to claim 1 wherein an imaginary apex of the conical portion lies on the center line at a distance rearwardly from the rear end face, which distance is greater than ¼ of L0.

10. A percussive rock drill comprising a drill bit attached to a drill rod by a thread joint, the drill bit including an integral skirt and defining a longitudinal center line, the bit including an axial front face having rock crushing elements, at least one channel for conducting a flush medium, a recess extending forwardly by an axial distance L0 from a rear end face of the skirt, a female thread formed in the recess and an external surface comprising a conical portion which extends rearwardly from a larger diameter end thereof to a smaller diameter end thereof wherein the larger diameter end is spaced from the rear end face by an axial distance which is greater than ⅛ of the distance L0 and less than the distance L0, wherein;

$$1 < A3/A2 < 1.6$$

where A2 is an imaginary area situated between a largest outer diameter D0 of the drill bit and an outer diameter of the skirt, such area A2 lying in a radial plane oriented perpendicular to the center line and being viewed in a direction parallel to the center line, where A3 is an imaginary area situated between the smallest diameter D3 of the recess and the largest outer diameter of the drill bit, such area lying in the radial plane and viewed in a direction parallel to the center line.

11. The rock drill according to claim 10 wherein a forward end of the recess is defined by an abutment surface, the external surface including a cylindrical portion surrounding the abutment surface.

12. The rock drill according to claim 11 wherein the conical portion forms an angle with the center line, the angle being greater than zero and no greater than 15 degrees.

13. The rock drill according to claim 10 wherein the conical portion forms an angle with the center line, the angle being greater than zero and no greater than 15 degrees.

14. A percussive rock drill comprising a drill bit attached to a drill rod by a thread joint, the drill bit including an integral skirt and defining a longitudinal center line, the bit including an axial front face having rock crushing elements, at least one channel for conducting a flush medium, a recess extending forwardly by an axial distance L0 from a rear end face of the skirt, a female thread formed in the recess and an external surface comprising a conical portion which extends rearwardly from a larger diameter end thereof to a smaller diameter end thereof wherein the larger diameter end is spaced from the rear end face by an axial distance which is greater than ⅛ of the distance L0 and less than the distance L0, wherein:

$$1<A3/A2<1.6$$

where A2 is an imaginary area situated between a largest outer diameter D0 of the drill bit and an outer diameter of the skirt, such area A2 lying in a first radial plane oriented perpendicular to the center line and being viewed in a direction parallel to the center line, where A3 is an imaginary area situated between the smallest diameter D3 of the recess and the largest outer diameter of the drill bit, such area lying in a second radial plane and viewed in a direction parallel to the center line.

15. The rock drill according to claim 14 wherein a forward end of the recess is defined by an abutment surface, the external surface including a cylindrical portion surrounding the abutment surface.

16. The rock drill according to claim 15 wherein the conical portion forms an angle with the center line, the angle being greater than zero and no greater than 15 degrees.

17. The rock drill according to claim 14 wherein the conical portion forms an angle with the center line, the angle being greater than zero and no greater than 15 degrees.

18. A drill bit for percussive rock drilling including an integral skirt defining an axial center line, the bit including an axial front face having rock crushing elements, at least one channel for conducting a flush medium, a recess extending forwardly by an axial distance L0 from a rear end face of the skirt, a female thread formed in the recess, and an external surface comprising a conical portion which extends rearwardly from a larger diameter end thereof to a smaller diameter end thereof, wherein the larger diameter end is spaced from the rear end face by an axial distance which is greater than ⅛ of the distance L0 and less than the distance L0, wherein $$D3^2 < D2^2 < \left(\frac{1}{1.6}D3^2 + \frac{0.6}{1.6}D0^2\right)$$

where D3 is a smallest diameter of the recess, D0 is a largest outer diameter of the drill bit, and D2 is a diameter of the skirt at an axial distance L2 from the rear end face, the distance L2 determined by a line extending from a first point to a second point at an angle of 45 degrees relative to a plane extending perpendicularly to the center line at the rear end face of the skirt, the first point defined by an intersection of the plane with an imaginary extension of the smallest diameter of the recess, and the second point defined by an intersection of the line with the outer surface of the skirt, the distance L2 being the axial distance from the plane to the second point.

19. The drill bit according to claim 18 wherein a forward end of the recess is defined by an abutment surface, the external surface including a cylindrical portion surrounding the abutment surface.

20. The drill bit according to claim 19 wherein the conical portion forms an angle with the center line, the angle being greater than zero and no greater than 15 degrees.

21. The drill bit according to claim 20 wherein $$\left(\frac{0.3}{1.3}D0^2 + \frac{1}{1.3}D3^2\right) < D2^2 < \left(\frac{1}{1.6}D3^2 + \frac{0.6}{1.6}D0^2\right).$$

22. The drill bit according to claim 18 wherein the conical portion forms an angle with the center line, the angle being greater than zero and no greater than 15 degrees.

23. The drill bit according to claim 18 wherein $$\left(\frac{0.3}{1.3}D0^2 + \frac{1}{1.3}D3^2\right) < D2^2 < \left(\frac{1}{1.6}D3^2 + \frac{0.6}{1.6}D0^2\right).$$

* * * * *